US009890993B1

(12) United States Patent
Sandberg

(10) Patent No.: US 9,890,993 B1
(45) **Date of Patent: *Feb. 13, 2018**

(54) COOLER WITH SECONDARY LID

(71) Applicant: Liddup, LLC, Las Vegas, CA (US)

(72) Inventor: Jayson T. Sandberg, Las Vegas, NV (US)

(73) Assignee: Liddup, LLC, Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/669,912

(22) Filed: Aug. 5, 2017

Related U.S. Application Data

(63) Continuation of application No. 14/686,780, filed on Apr. 15, 2015, now Pat. No. 9,726,424.

(60) Provisional application No. 61/988,255, filed on May 4, 2014.

(51) Int. Cl.

| | |
|---|---|
| ***F21V 33/00*** | (2006.01) |
| ***F25D 27/00*** | (2006.01) |
| ***F25D 3/08*** | (2006.01) |
| ***A45C 15/06*** | (2006.01) |
| *F25D 3/00* | (2006.01) |

(52) U.S. Cl.
CPC ..... *F25D 27/005* (2013.01); *A45C 15/06* (2013.01); *F25D 3/08* (2013.01); *F21V 33/00* (2013.01); *F25D 3/00* (2013.01); *F25D 2400/10* (2013.01)

(58) Field of Classification Search
CPC . F25D 27/005; F21V 23/0414; F21V 33/0004
USPC ..... 362/94
See application file for complete search history.

(56) References Cited

U.S. PATENT DOCUMENTS 9,726,424 B1 * 8/2017 Sandberg ..... F25D 27/005

* cited by examiner

*Primary Examiner* — Elmito Breval
*Assistant Examiner* — Omar Rojas Cadima
(74) *Attorney, Agent, or Firm* — Clause Eight IPS; Michael Catania

(57) ABSTRACT

A cooler with a modular light bar having multiple LEDs and a secondary lid is disclosed herein. The LEDs are preferably automatically activated by a switch positioned in the cooler. When the lid is in an open state, the switch completes a circuit from a battery to the LEDs of the modular light bar thereby allowing the LEDs to illuminate the entire interior chamber of the cooler.

17 Claims, 24 Drawing Sheets

COOLER WITH SECONDARY LID

CROSS REFERENCES TO RELATED APPLICATIONS

The Present application is a continuation application of U.S. patent application Ser. No. 14/686,780, filed on Apr. 15, 2015, which claims priority to U.S. Provisional Patent Application No. 61/988,255, filed on May 4, 2014, both of which are hereby incorporated by reference in their entireties.

STATEMENT REGARDING FEDERALLY SPONSORED RESEARCH OR DEVELOPMENT

Not Applicable

BACKGROUND OF THE INVENTION

Field of the Invention

The present invention generally relates to portable beverage coolers.

Description of the Related Art

The prior art discusses various coolers, including coolers with lighting.

Winslow, U.S. Pat. No. 4,754,376 for an Automatic Ice Chest Light discloses a lighting device (light bulb) attached to n interior surface of a lid of an ice chest that is automatically activated when the lid is raised and deactivates when the lid is closed by way of a mercury switch.

Bania, U.S. Pat. No. 6,182,462 for an Internally Illuminated Cooler Box, discloses an incandescent light bulb built into an internal wall of a lid of a cooler box and which is activated by an automatic spring loaded switching mechanism.

Pashley et al., U.S. Pat. No. 6,726,341 for a LED Illumination For Cold Storage Compartments discloses the use of LED lighting for a cold storage compartment.

Blanchard et al., U.S. Pat. No. 6,519,965 for an Externally Illuminated Cooler Box, discloses an incandescent light bulb built into an external side wall of a cooler box and which is activated by a switching mechanism.

Wyatt, U.S. Pat. No. 6,997,007 for a Light Assembly And Cooler System discloses a light assembly positioned on a front wall of a cooler and having an interior illumination panel and an exterior illumination panel which is controlled by a switch that deactivates the lighting when the lid is closed.

Incandescent lights have heat-driven emissions which use an electric current through a filament and produce light along with heat. This light source is completely useless for application to a cooler since it directly takes away from the basic functionality of a cooler. Fluorescent lights use a gas-discharge lamp and electricity to excite mercury vapor, producing a short-wave ultraviolet light that causes a phosphor to fluoresce, in turn producing actual, visible light. This type of light source is cost efficient however requires a ballast to regulate current through a bulb or lamp. Ballasts take up volume and generate heat. Since volume maximization is a primary attribute to be contained, a fluorescent light with a ballast is an improbable solution. Also, fluorescent bulbs are extremely fragile, with the possibility of breakage upon closing of the lid which would expose the hazardous gas and mercury within the cooler.

The prior art, although providing various means for illuminating a cooler, has still not addressed all of the problems with illuminating a portable cooler. The entire interior of the cooler should be illuminated and should be illuminated for an extensive period without an external power source. Also, the illumination should only create a minimal amount of heat in order for the cooler to serve its primary function of cooling the contents of the cooler. The cooler should also have an "automatic" switch to activate the illumination, and the switch should be durable.

BRIEF SUMMARY OF THE INVENTION

The cooler of the present invention resolves the problems associated with prior art coolers by providing a cooler a modular light bar that utilizes multiple light emitting diodes ("LED") to illuminate the entire interior of the cooler by unique placement of the LEDs which allows for a minimal number of LEDs to minimize power consumption. The LEDs are preferably activated by a magnetic reed switch positioned between an inside liner and an outer liner of the cooler. A magnet of the magnetic reed switch is positioned in the lid. A magnetic field of the magnet is in an activating location when the lid is in an open state wherein the magnetic reed switch completes a circuit from a battery to the modular light bar thereby allowing the LEDs to illuminate the entire interior of the chamber of the cooler. The modular light bar is preferably positioned along an upper region of the main body in which the upper region extends from an upper edge of the main body to 2 inches below the upper edge. The interior chamber preferably has a volume ranging from 40 quarts to 50 quarts. The LEDs can preferably illuminate the interior chamber of the cooler for at least four hours of continuous use.

The present invention is an insulated cooler with a lid connected of the body that opens. The interior of the cooler has LEDs along the interior rim approximately 1.5 inches from the top. The LEDs are preferably activated by a magnetic reed switch when the lid is opened, the reed switch closes the circuit on the common or ground side which completes the circuit and activates/powers the LEDs. When the lid is closed, the reed switch opens the circuit and deactivates the LEDs. The magnet is preferably positioned inside of the lid to activate/deactivate the reed switch. When a lied with a smaller or secondary lid is incorporated into the lid, a second reed switch is used. When the smaller/top lid is opened, the LEDs are activated by the second reed switch connected in to the same circuit (ground/common). The LEDs are activated by opening either the main/large lid or the second/top/smaller lid. The second lid reed switch is connected with wires that run through the back bottom middle of the lid into the hinge, through the hinge and connect at the base to the main circuit, The present invention is generally directed to a portable cooler with a modular light bar. An illustrative embodiment of the cooler includes a lid and an interior chamber. The cooler has a main body having a plurality of insulated walls that define an interior chamber and a lid attached to the main body wherein the lid is moveable from a closed state to an open state. A modular light bar is positioned along an upper region of the main body and has a plurality of LEDs, with each LED having a millicandela ranging from 4000 to 20000. Further included is a nine volt battery for providing power to each of the plurality of LEDs. There is also preferably at least one 1.5 watt 5% tolerance 220 ohm resistor positioned between the nine volt battery and the plurality of LEDs. A magnetic reed switch is positioned between an inside liner and an outer liner of the cooler. A magnet is positioned in the lid wherein the magnetic field of the magnet is in an activating location when the lid is in an open state and wherein the magnetic field is removed from the magnetic reed switch when the lid is in an open state which allows the magnetic reed switch to close and complete a circuit from the battery to the plurality of LEDs allowing the plurality of LEDs to automatically illuminate the interior of the chamber. The cooler also has a secondary lid with a second reed switch. The present invention is further directed to a circuit for a lighting system for the cooler having a lid and interior chamber.

In another embodiment of the present invention, the cooler is capable of illuminating an exterior and comprises a main body having a plurality insulated walls that define an interior chamber, each of the insulated walls having an interior surface and an exterior surface. A lid is attached to the main body, the lid moveable from a closed state to an open state. The cooler also has a secondary lid with a second reed switch. The cooler further comprises a modular light bar positioned along the outer surface of an insulated wall of the plurality of insulated walls of the main body. The modular light bar has a plurality of LEDs and each of the LEDs has a millicandela of at least 20000. The cooler comprises a nine volt battery for providing power to each of the plurality of LEDs and at least one 1.5 watt 5% tolerance 220 ohm resistor positioned between the nine volt battery and the plurality of LEDs. Further included is an on/off rocker switch positioned on the main body, the on/off rocker switch completing a circuit from the battery to the plurality of LEDs allowing the plurality of LEDs to an exterior area to the cooler.

Having briefly described the present invention, the above and further objects, features and advantages thereof will be recognized by those skilled in the pertinent art from the following detailed description of the invention when taken in conjunction with the accompanying drawings.

BRIEF DESCRIPTION OF THE SEVERAL VIEWS OF THE DRAWINGS

FIG. 27 B is an isolated cross-sectional side view a modular light bar for a cooler with modular lighting being positioned within a slot of a wall of the cooler.

DETAILED DESCRIPTION OF THE INVENTION

Figure 1:
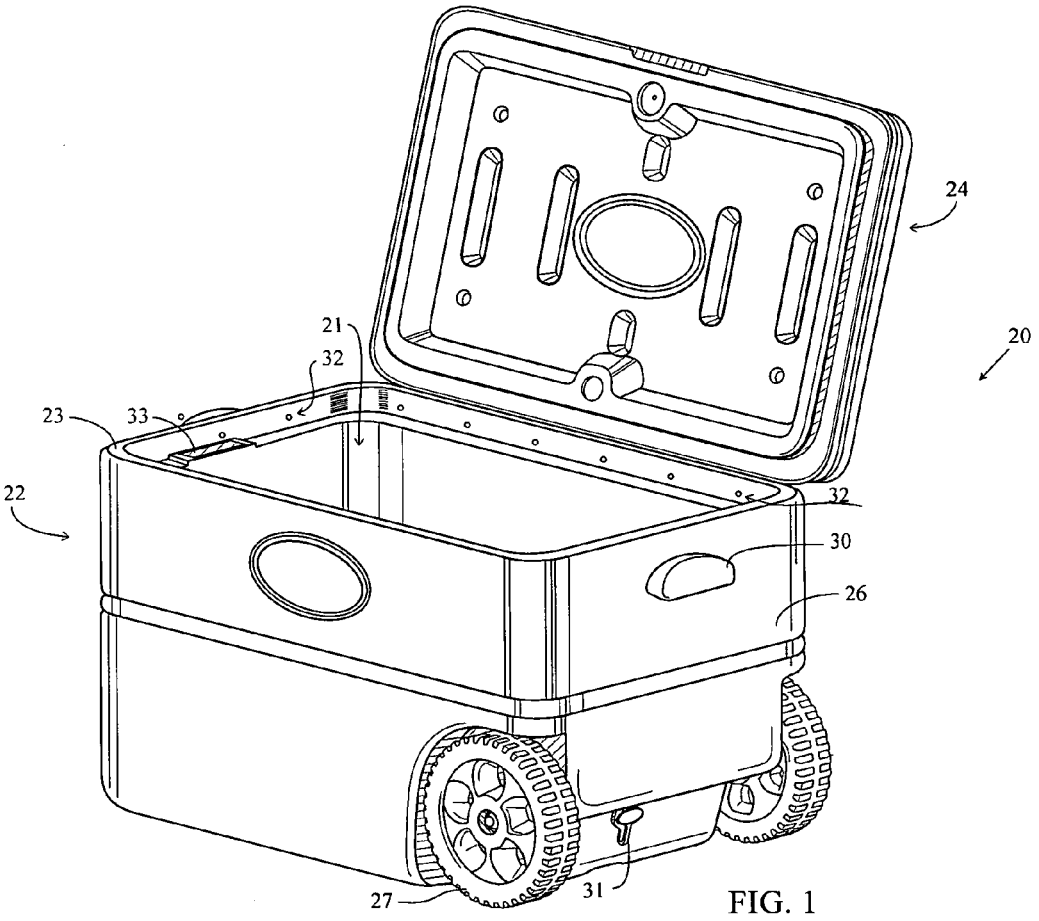
FIG. 1 is a top perspective view of a preferred embodiment of a cooler.
Figure 1A:
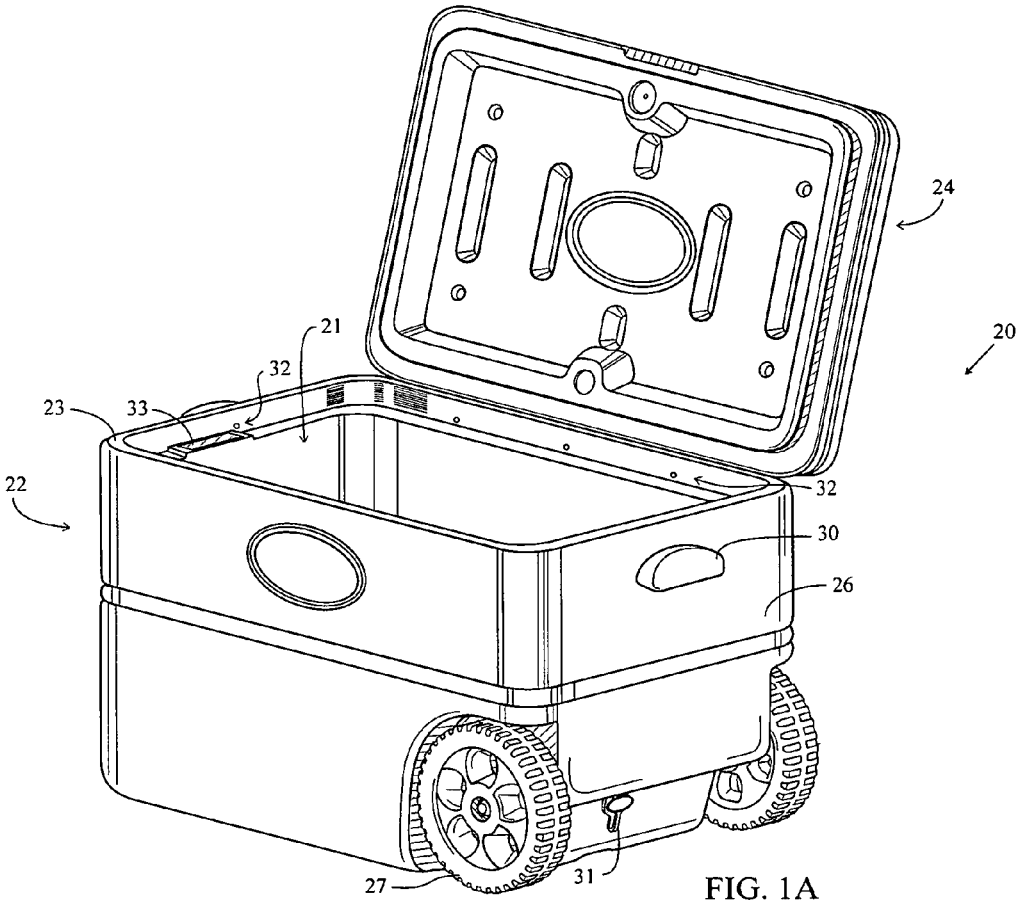
FIG. 1A is a top perspective view of an alternative embodiment of a cooler.
Figure 2:
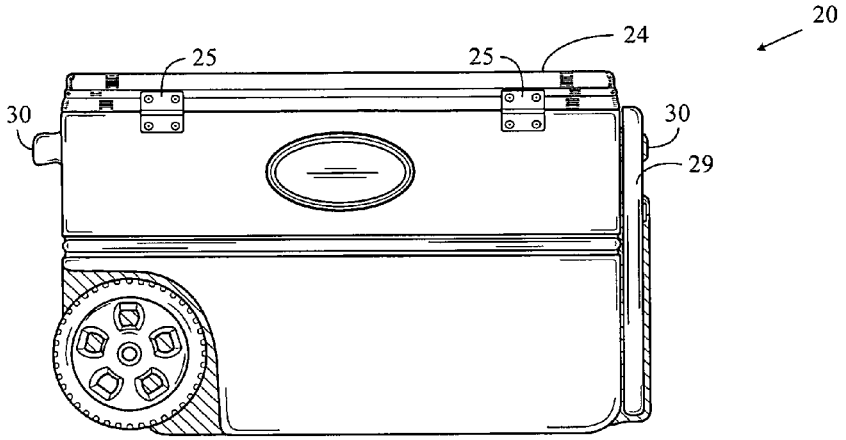
FIG. 2 is a hinged side elevational view of a preferred embodiment of a cooler.
Figure 3:
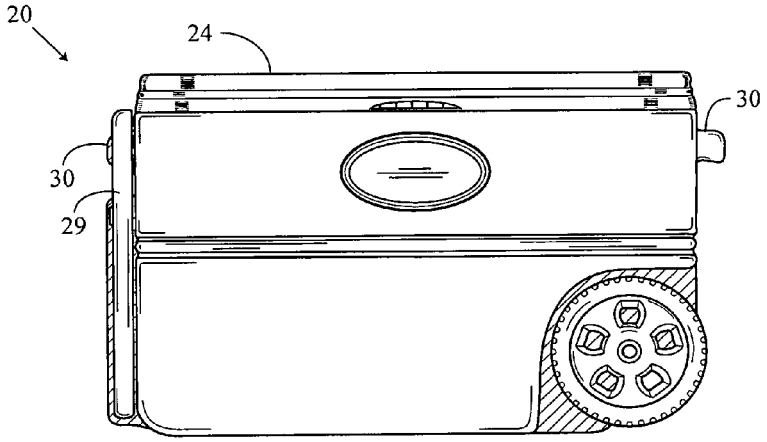
FIG. 3 is a side elevational view of a preferred embodiment of a cooler.

As shown in FIGS. 1 and 1A, a portable cooler 20 has a lid 24 and a main body 22 having an interior chamber 21. The lid 24 is preferably made of high density polyethylene (HDPE). The main body 22 comprises an outer liner 26 and an inner liner 34 that defines an interior chamber 21. The lid 24 is attached to the main body 22, and the lid 24 movable from a closed state to an open state. Multiple LEDs 32 are positioned along an upper region of the main body 22. Each of the plurality of LEDs 32 preferably has a millicandela ranging from 4000 to 20000. The cooler 20 also preferably has a pair of wheels 27 and a drain plug 31.

The cooler 20 further preferably comprises at least one battery 41, positioned within a battery compartment, for providing power to each of the plurality of LEDs 32. The battery 41, not shown, preferably has a battery cover with backing made of polypropylene (PP). The preferred thickness of the wall of the backing is approximately 0.100 inch and the preferred weight is approximately 0.010 pounds. Additionally, the battery 41, not shown, preferably has at least a 0.025 inch thick adhesive backed foam on the bottom of the battery 41. The battery 41 is preferably placed in the battery compartment, which is in the upper region of the main body 22 to allow for maximum cooler space. Further, the battery is in close proximity to plurality of LEDs 32 in order to reduce power loss through resistance of the wires and to prevent unnecessary heating of the cooler by having electrical wires conducting electricity positioned throughout the cooler 20.

At least one 1.5 watt 5% tolerance 220 ohm resistor 40 is preferably positioned between a nine volt battery 41 and the plurality of LEDs 32.

The foam of the main body 22 of the cooler 20 preferably weighs approximately 2.6 to 3.0 pounds. The foam of the lid 24 of the cooler roughly weighs between 0.2 to 0.8 pounds. The interior capacity of the cooler 20 is preferably approximately 48 quarts to 50 quarts.

As shown in FIGS. 9-11 and 15-17, the cooler 20 is further defined by an inner liner 34 and an outer liner 26 of the main body 22. A switch 42 is positioned between the inner liner 34 and outer liner 26 of the main body 22 in a compartment 33.

Figure 11:
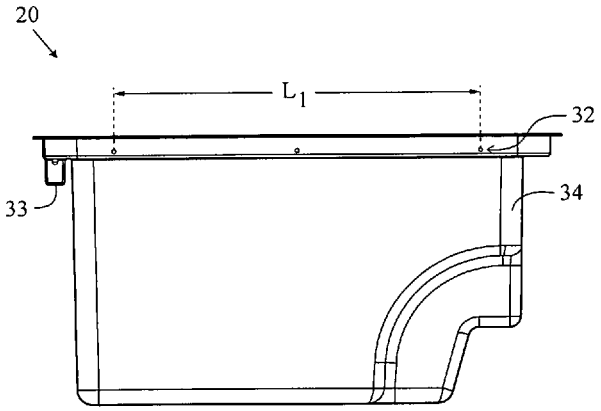
FIG. 11 is a side elevational view of an inner liner of a main body of a preferred embodiment of a cooler.

In this embodiment, the switch is a magnet reed switch 42. The liner is preferably made of high density polyethylene (HDPE). Further, a magnet 45 is positioned in the lid 24, wherein a magnetic field 46 of the magnet 45 is in an activating location when the lid 24 is in an open state, wherein the magnetic reed switch 42 completes a circuit 40 from the battery 41 to the plurality of LEDs 32 thereby allowing the plurality of LEDs 32 to illuminate the interior of the chamber 21 of the cooler 20. As shown in FIG. 11, a distance L1 is preferably approximately 16 inches.

Figure 12:
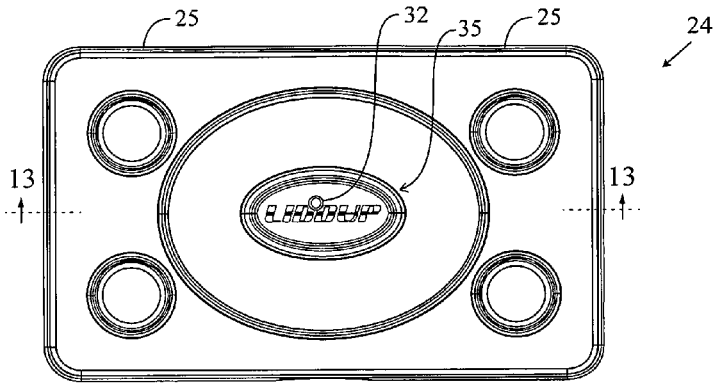
FIG. 12 is a top plan view of a lid of an alternative embodiment of a cooler.
Figure 13:
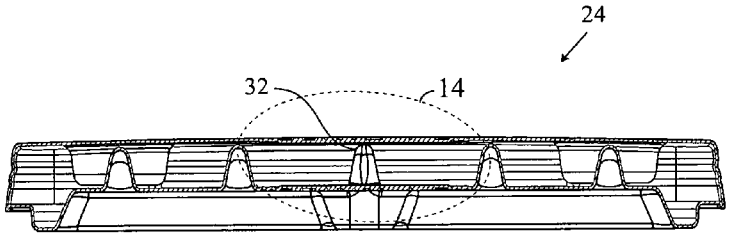
FIG. 13 is a cross-sectional view of the lid of FIG. 12 along line 13-13.
Figure 14:
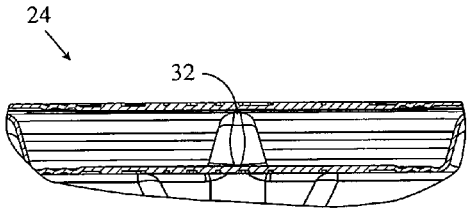
FIG. 14 is an isolated view of portion 14 of FIG. 13.
Figure 15:
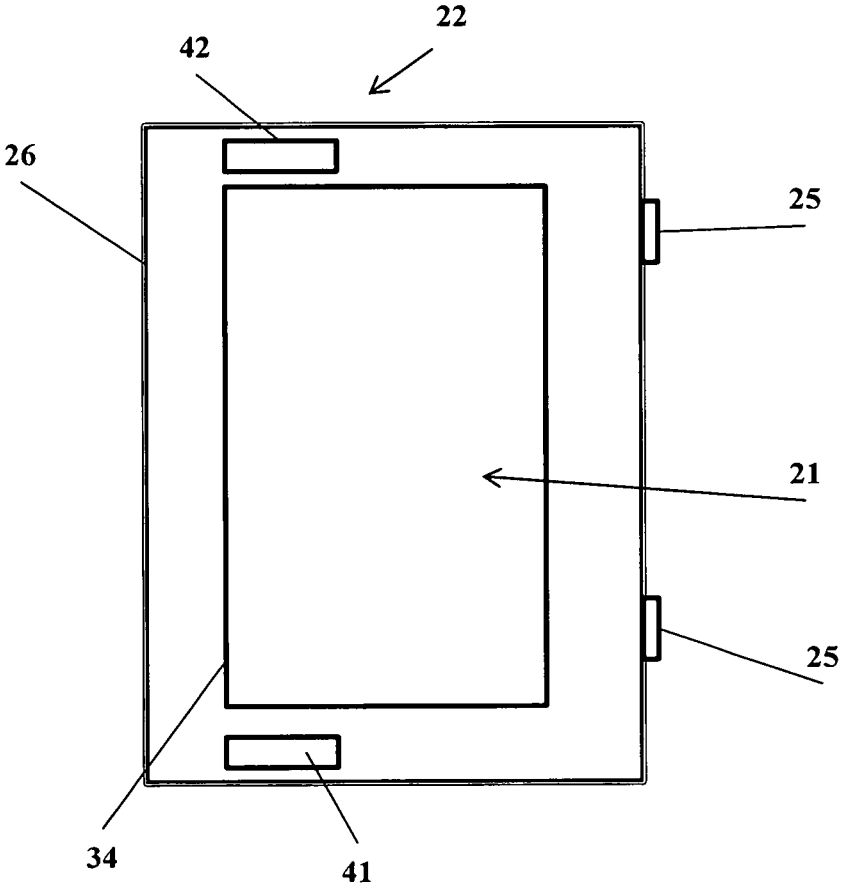
FIG. 15 is a plan view of a main body of a cooler illustrating a magnetic reed switch positioned within an outer liner and inner liner of the main body.
Figure 16:
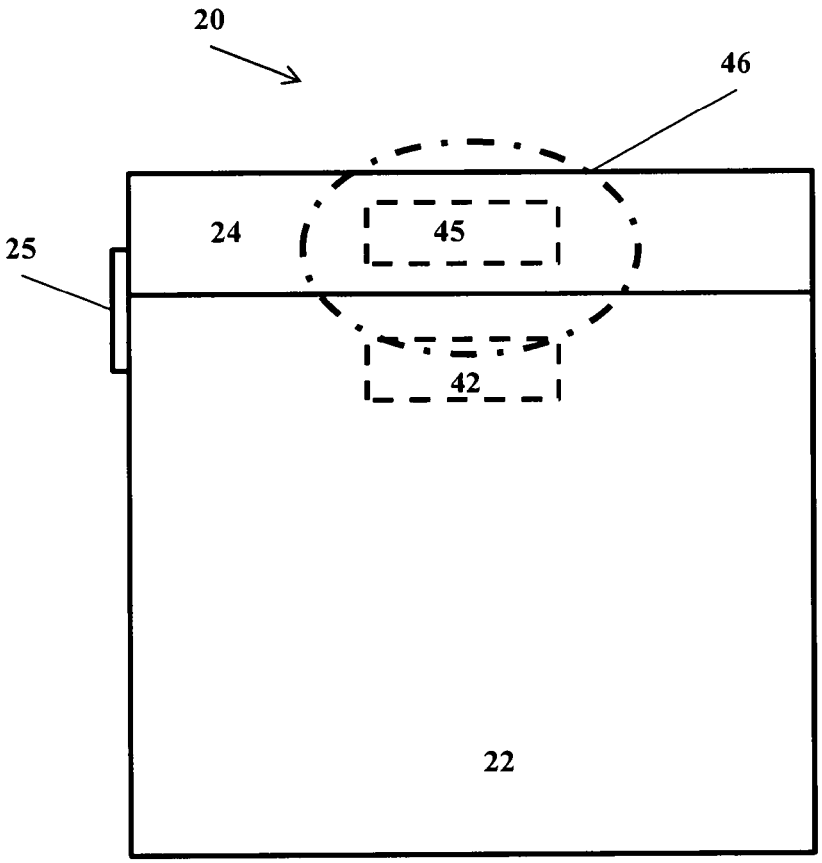
FIG. 16 is a side view of a cooler in a closed lid state with a magnetic reed switch in dashed lines in a main body of the cooler and a magnet in dashed lines in a lid of the cooler with a magnetic field in dashed lines.

In an alternative embodiment of the present invention illustrated in FIGS. 12-14, the cooler 20 is capable of illuminating an exterior area of the cooler 20 through an LED 32 in a lid illuminating area 35 of the lid 24. The material of the lid illuminating area 35 is preferably transparent allowing for the LED 32 to illuminate an exterior area of the cooler 20.

The cooler 20 comprises a main body 22 having a plurality of insulated walls that define an interior chamber 21. Each of the plurality of insulated walls has an interior surface that is preferably white in color, which is standard in the cooler industry. The white interior surface serves multiple purposes for the cooler 20, in addition to providing a reflecting amplifier for the LEDs 32, allowing for fewer and lower power LEDs 32 to be used while still illuminating the entire interior chamber 21 of the cooler 20.

Figure 4:
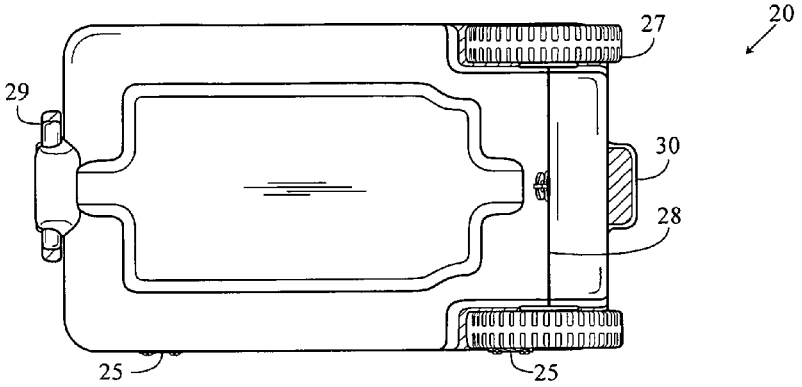
FIG. 4 is a bottom plan view of a preferred embodiment of a cooler.
Figure 5:
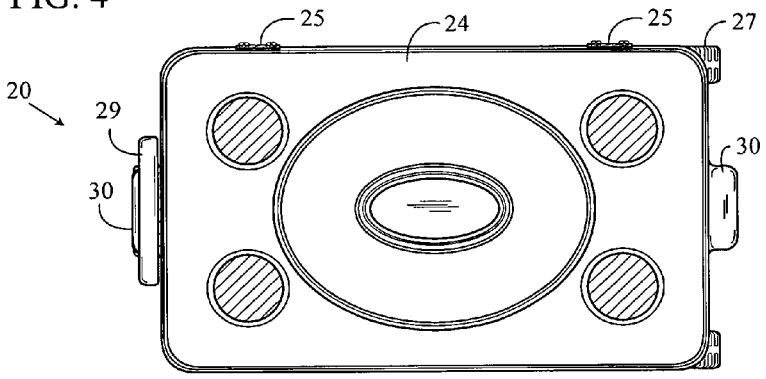
FIG. 5 is a top plan view of a preferred embodiment of a cooler.
Figure 6:
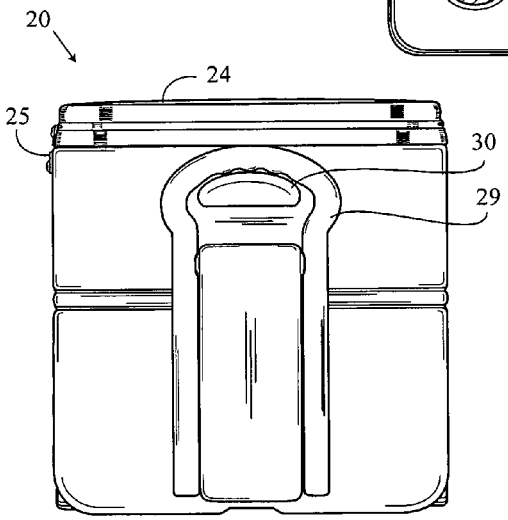
FIG. 6 is a front elevational view of a preferred embodiment of a cooler.
Figure 7:
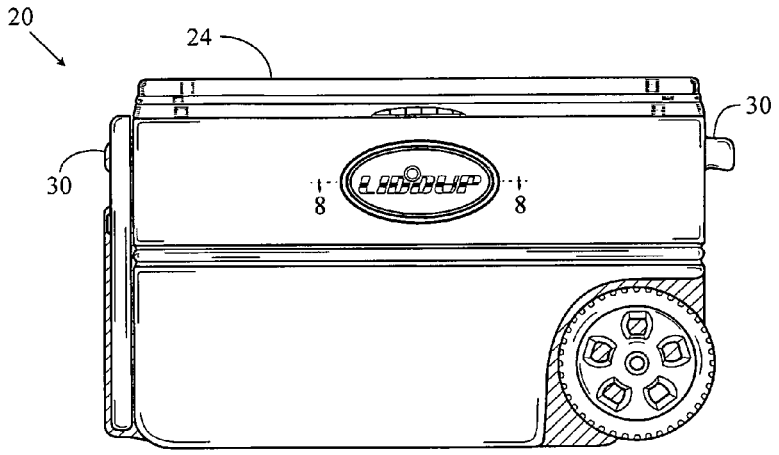
FIG. 7 is a side elevational view of an alternative embodiment of a cooler.
Figure 8:
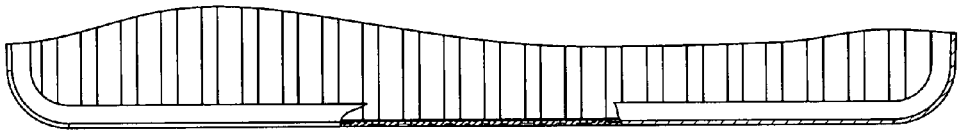
FIG. 8 is a cross-sectional view along line 8-8 of FIG. 7 illustrating a transparent portion of an outer liner of a main body of a cooler.
Figure 9:
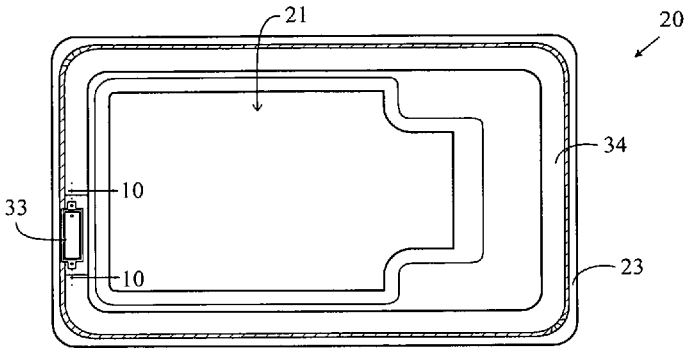
FIG. 9 is a top plan view of a main body of a preferred embodiment of a cooler illustrating an open interior of the main body of the cooler.
Figure 10:
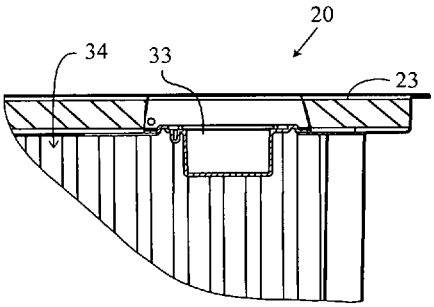
FIG. 10 is an isolated cross-sectional view of a portion of the cooler along lines 10-10 of FIG. 9.

As shown in FIGS. 2-8, the lid 24 of the cooler 20 is attached to the main body 22 by a plurality of hinges 25, wherein the lid 24 is movable from a closed state to an open state. The hinges 25 are placed on a hinge side of the cooler 20 while the magnetic reed switch 42, not shown, is preferably positioned on an opposite of the hinge side as disclosed below. The cooler 20 preferably has a pair of gripping handles 30 and a pulley handle 29 opposite of the wheels 27. As shown in FIG. 4, the wheels 27 are preferably attached to each other by a rotating shaft 28. As shown in FIGS. 7 and 8, an alternative embodiment has a transparent signage portion that may be illuminated by an LED.

Figure 18:
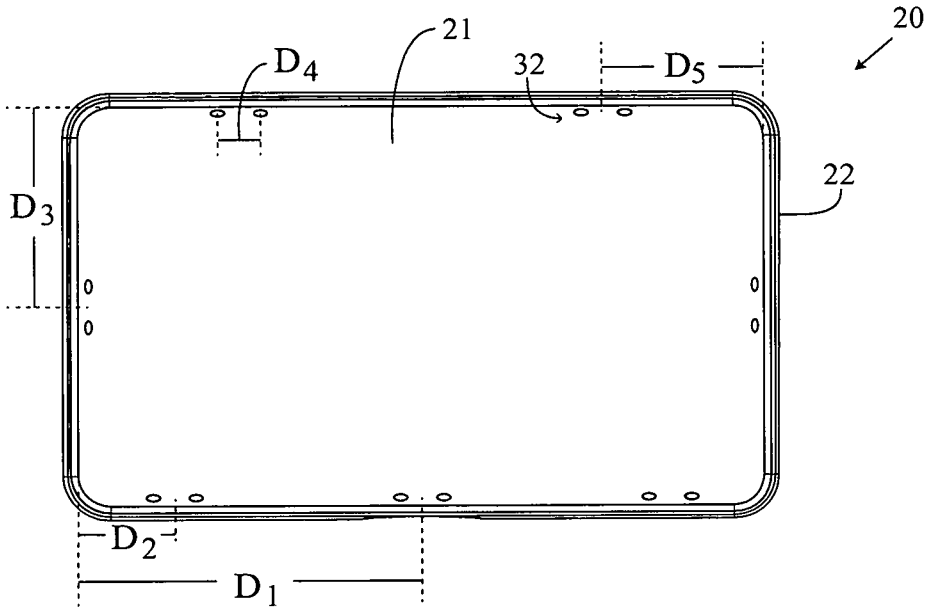
FIG. 18 is a top view of an isolated view of the interior of the cooler.

As shown in FIGS. 1, 1A and 18, a plurality of LEDs 32 are positioned along the interior surface of the main body 22 of the cooler, below a rim 23 of the main body 22. The LEDs 32 are the preferred light source for application in the cooler 20 since LEDs are more energy-efficient than traditional light sources, emit low-intensity light, generate the absolute minimum amount of heat and do not take up any volume in the cooler 20. Placement of the LEDs 32 is designed for maximum illumination from the minimal number of LEDS 32, as well as utilizing reflection of the white interior liner. In one embodiment, the placement of the LEDs 32 is in the upper region of the cooler 20 where the lid 24 rests when in a closed position. The placement of the LEDs 32 in the upper lip of the cooler 20 allows for physical protection of the LEDs 32 when the lid 24 is in the closed position. Further, by placing the LEDs 32 as close as possible to the rim 23 of the cooler 20, optimal cooler 20 space is maximized. Also, placement of the LEDs 32 in this location allows for the maximum reflection amplification from the interior liner, regardless of the contents inside the cooler 20.

Each of the plurality of LEDs 32 preferably has a millicandela ranging from about 4,000 to roughly 20,000. The LEDs 32 are preferably 5 mm flat top 120 degree LEDs. The 5 mm flat top 120 degree LEDs do not have a focused beam and do not have a domed surface which reduces illumination of the chamber. The invention further comprises a nine-volt battery 41 for providing power to each of the plurality of LEDs 32. To prevent power from the battery being drained quickly, at least one 1.5 watt 5% tolerance 220 ohm resistor 40 is positioned between the nine volt battery 36 and the plurality of LEDs 32.

Figure 19:
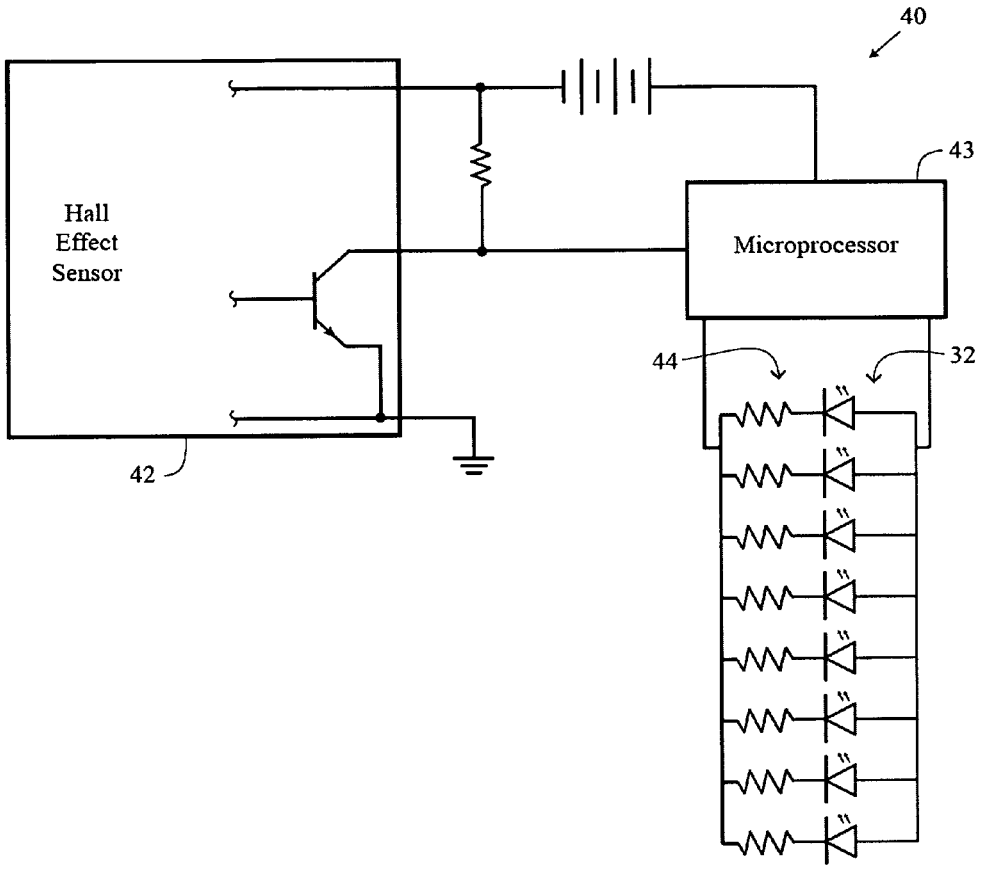
FIG. 19 is a block diagram of a circuit for a cooler with modular lighting.
Figure 19A:
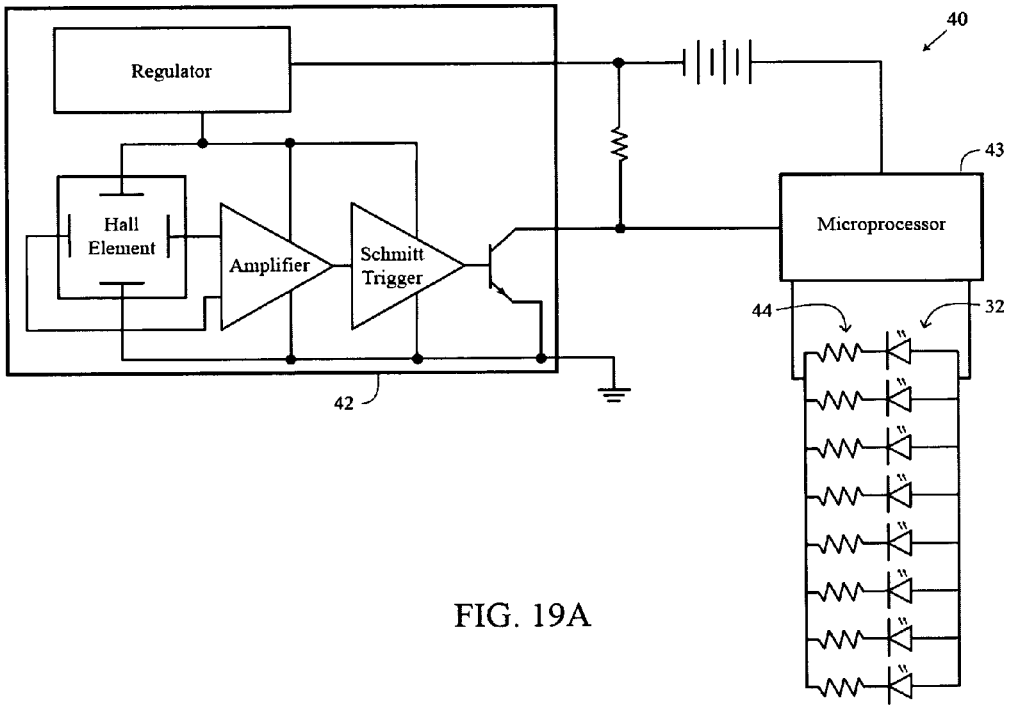
FIG. 19A is a block diagram of a circuit for a cooler with modular lighting with a Hall Effect Sensor.

As shown in FIGS. 19 and 19A, the circuit 40 for a lighting system for a cooler 20 comprises a plurality of LEDs 32, each of the plurality of LEDs 32 preferably has a millicandela ranging from 4000 to 20000. The circuit 40 further comprises a nine volt battery, a switch 42, and at least one 1.5 watt 5% tolerance 220 ohm resistor 40 positioned between the switch 42 and the plurality of LEDs 32. A microprocessor or circuit board 43 is also preferably utilized in the circuit 40.

In this embodiment, the switch is a Hall Effect sensor 42 which is positioned between the nine volt battery 41 and the plurality of LEDs 32. The Hall Effect sensor 42 includes a regulator, a Hall element, an amplifier and a Schmitt trigger. A Hall Effect sensor 42 is a transducer that varies its output voltage in response to changes in a magnetic field. The Hall effect sensor is similar to the magnetic reed switch disclosed above, albeit with no moving components. In response to the lack of a magnetic field, the Hall Effect sensor closes a circuit and activates the LEDs 32 of the cooler 20 thereby allowing power to flow from the battery 41 to each of the plurality of LEDs 32 for automatically illuminating the interior of the chamber 21 of the cooler 20 when the lid is open and the magnetic field is removed.

Figure 17:
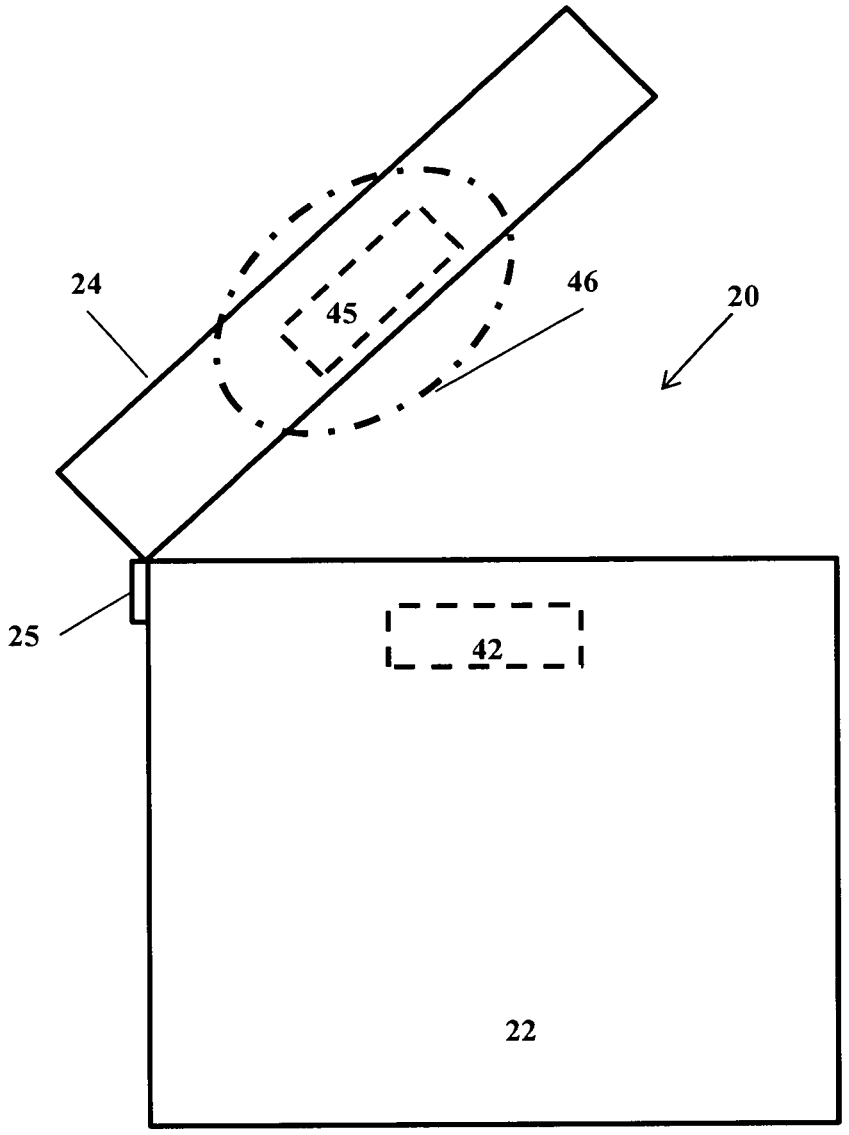
FIG. 17 is a side view of a cooler in an open lid state with a magnetic reed switch in dashed lines in a main body of the cooler and a magnet in dashed lines in a lid of the cooler with a magnetic field in dashed lines.

The switch 42 is preferably installed between the inside liner 34 and the outside liner 26 of the main body 22 of the cooler 20. Also, the activation by the removal of the magnetic field 46 (as shown in FIG. 17) generated by the magnet 45 in the lid 24 eliminates breakage from wires that must be placed in a lid of a cooler since the magnet 45 is positioned within the lid 24 without the need for wires or other connections.

Figure 20:
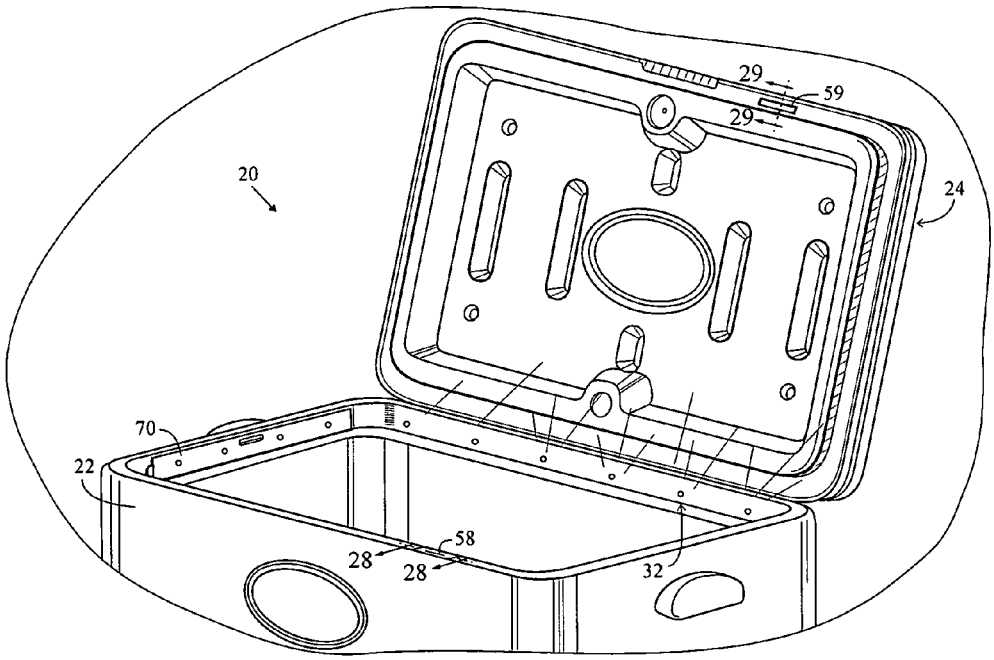
FIG. 20 an illustration of a cooler with modular lighting with a lid open to automatically activate the modular lighting.
Figure 28:
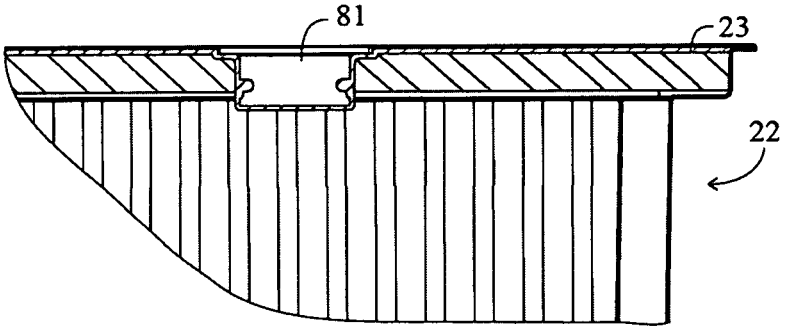
FIG. 28 is an isolated cross-sectional view along lines 28-28 of FIG. 20 of a switch docking bay for a cooler with modular lighting.
Figure 29:
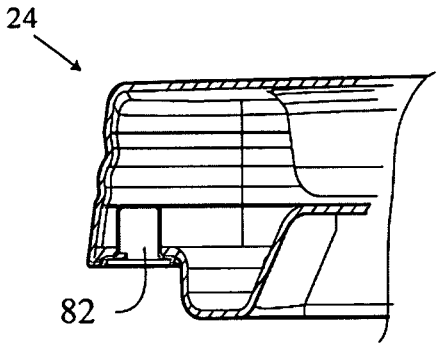
FIG. 29 is an isolated cross-sectional view along lines 29-29 of FIG. 20 of a lid switch docking bay for a cooler with modular lighting.
Figure 30:
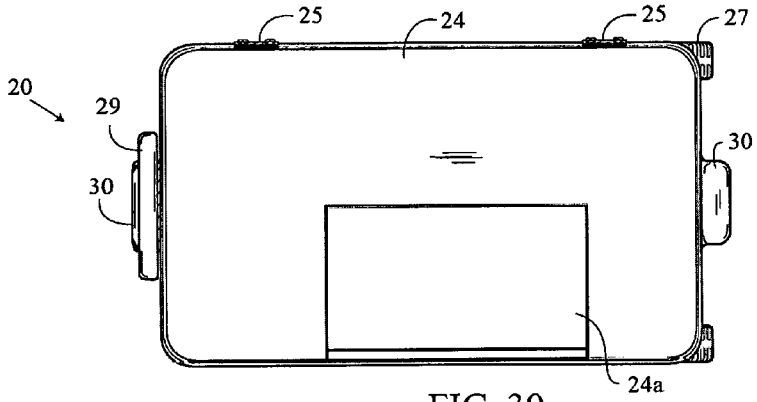
FIG. 30 is a top plan view of a cooler with a secondary lid.
Figure 30A:
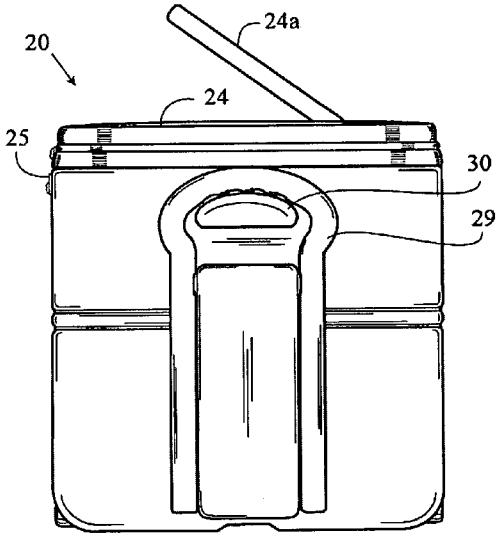
FIG. 30A is a side elevation view of a cooler with a secondary lid.
Figure 31:
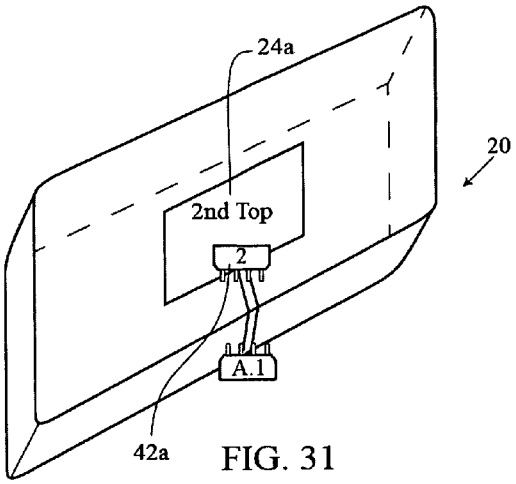
FIG. 31 is a view of a cooler with a secondary lid illustrating the internal components.
Figure 31A:
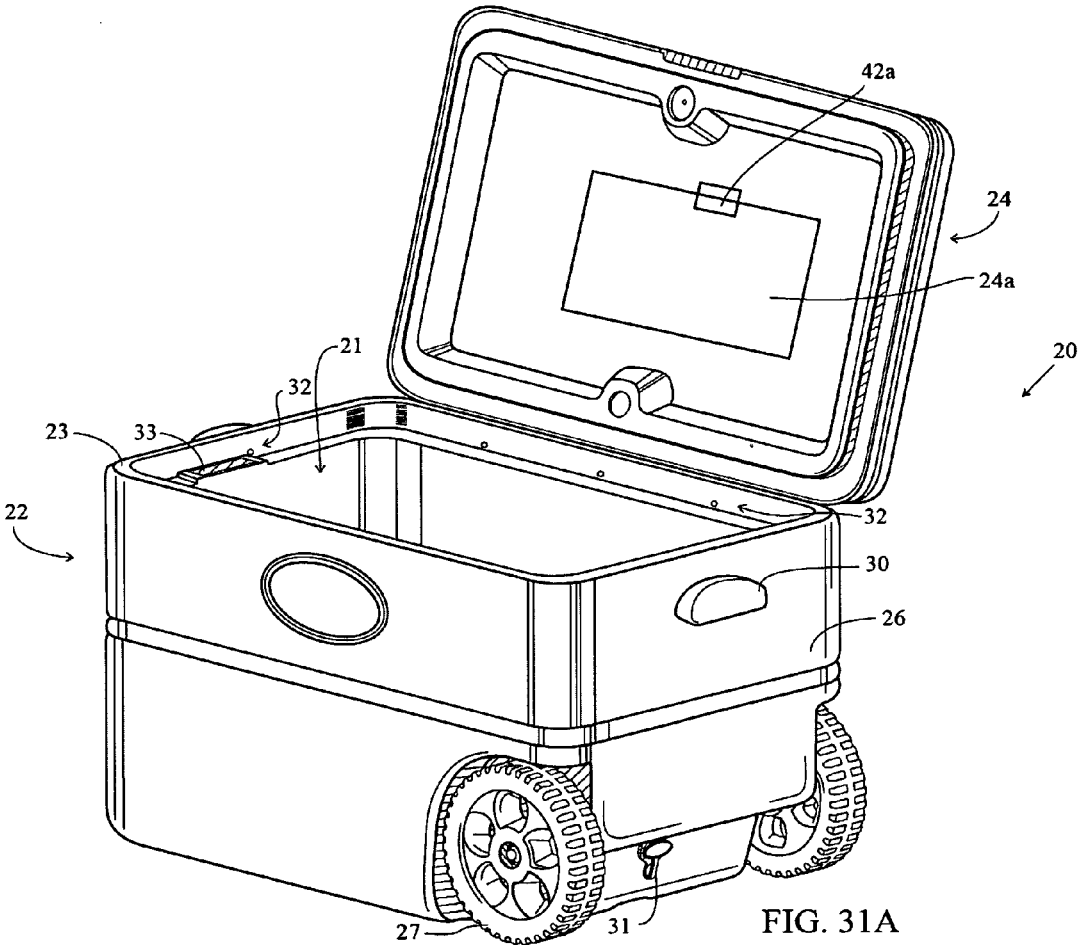
FIG. 31A is a top perspective view of a cooler with a secondary lid with a primary lid in the open position.

An alternative embodiment of a cooler 20 with modular lighting is shown in FIG. 20. The modular light bar 70 is placed within an interior docking bay 76 of a wall 26 of the cooler 20. A lid component 59 of the switch is placed within the lid 24 and a main body component 58 of the switch is placed within the main body 22. FIGS. 28 and 29 illustrate this aspect of the invention without the switch components 58 and 59. The switches discussed below are utilized with the modular light bar 70, and positioned within the switch docking bay 81 and the lid switch docking bay 82 in order to automatically activate (close the circuit) the LEDs 32 of the modular light bar 70 when the lid 24 of the cooler 20 is open, and t0 automatically shut off (open the circuit) the LEDs 32 of the modular light bar 70 when the lid 24 is closed.

Figure 20A:
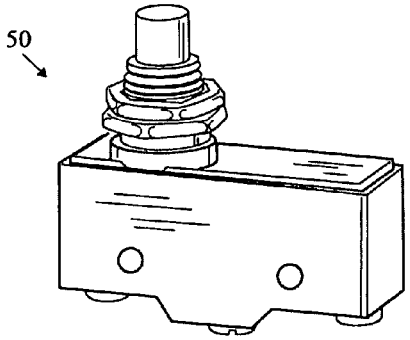
FIG. 20A is an illustration of a plunger switch utilized with a cooler with modular lighting.

A plunger switch 50 utilized with a cooler with modular lighting is illustrated in FIG. 20A. The plunger switch 50 breaks (off) or completes (on) a circuit on the common side of the circuit. When the lid 24 of the cooler 20 is in the closed position the plunger is pressed, breaking the circuit on the common side of the circuit, turning the LEDS 32 off (open circuit). When the lid 24 of the cooler 20 is open the plunger is released, completing the circuit on the common side turning the LEDS 32 on (closed circuit).

Figure 20B:
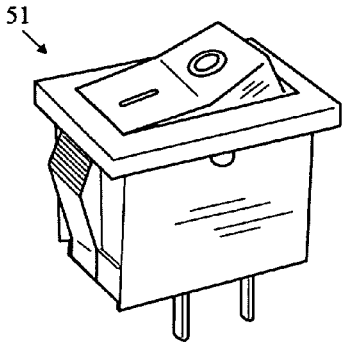
FIG. 20B is an illustration of a rocker switch utilized with a cooler with modular lighting.

A rocker switch 51 utilized with a cooler with modular lighting is illustrated in FIG. 20B. An on/off rocker switch 51 is positioned on the main body 22 and the on/off rocker switch completes a circuit 40 from the battery 41 to the plurality of LEDs 32 thereby allowing the plurality of LEDs 32 to illuminate an exterior area to the cooler 20. The rocker switch 51 breaks (off) or completes (on) a circuit on the common side of the circuit. Activation of the rocker switch 51 requires the switch be manually or physically rocked into the on or off position. When the lid 24 of the cooler 20 is open the switch would be switched to the on position, completing the circuit and activating the LEDS 32 (closed circuit). When the cooler lid 24 is shut the switch would then need to be turned into the off position, breaking the circuit and deactivating the LEDS 32 (open circuit).

Figure 20C:
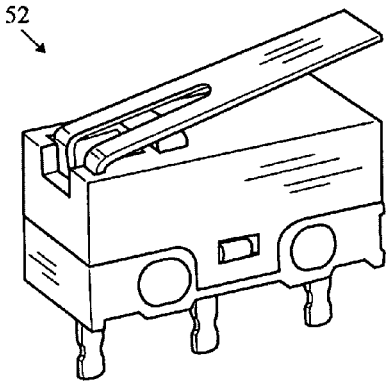
FIG. 20C is an illustration of a lever switch utilized with a cooler with modular lighting.

A lever switch 52 utilized with a cooler with modular lighting is illustrated in FIG. 20C. The lever switch 52 breaks (off) or completes (on) a circuit on the common side of the circuit. When the lid 24 of the cooler 20 is in the closed position the lever is pressed, breaking the circuit on the common side of the circuit, turning the LEDS 32 off (open circuit). When the lid 24 of the cooler 20 is open the lever is released, completing the circuit on the common side turning the LEDS 32 on (closed circuit).

Figure 20D:
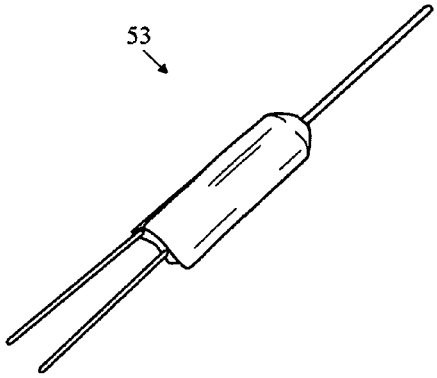
FIG. 20D is an illustration of a ball switch utilized with a cooler with modular lighting.

A ball switch 53 utilized with a cooler with modular lighting is illustrated in FIG. 20D. The ball switch 53 breaks (off) or completes (on) a circuit on the common side of the circuit. When the lid 24 of the cooler 20 is in the closed position the ball rolls away from the common leads inside of the switch breaking the circuit, turning the LEDS 32 off (open circuit). When the lid 24 of the cooler 20 is open, the ball rolls towards the common leads completing the circuit or turning the LEDS 32 on (closed circuit).

Figure 20E:
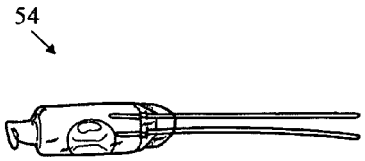
FIG. 20E is an illustration of a mercury switch utilized with a cooler with modular lighting.

A mercury switch 54 utilized with a cooler with modular lighting is illustrated in FIG. 20E. The mercury switch 54 breaks (off) or completes (on) a circuit on the common side of the circuit. When the lid 24 of the cooler 20 is in the closed position the mercury rolls away from the common leads inside of the switch breaking the circuit turning the LEDS 32 off (open circuit). When the lid 24 of the cooler 20 is open the mercury rolls into the common leads, completing the circuit on the common side turning the LEDS on (closed circuit).

Figure 20F:
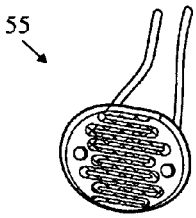
FIG. 20F is an illustration of a light dependent resistor switch utilized with a cooler with modular lighting.

A light dependent resistor switch 55 utilized with a cooler with modular lighting is illustrated in FIG. 20F. The light dependent resistor switch 55 is a small semiconductor. Similar to the photo diode switch discussed below, in low to no ambient light situations, the light dependent resistor switch 55 completes the circuit so the LEDS 32 will illuminate.

Figure 20G:
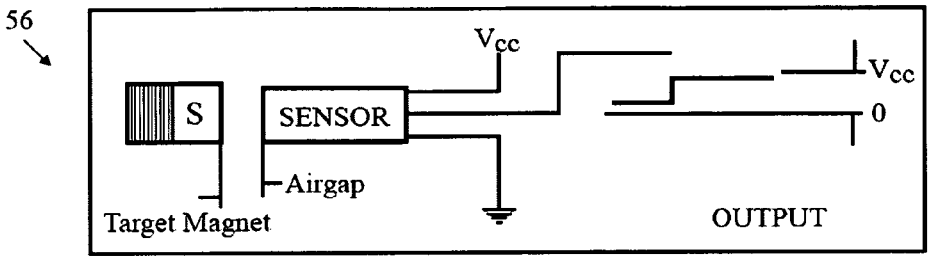
FIG. 20G is an illustration of a proximity switch utilized with a cooler with modular lighting.

A proximity switch 56 utilized with a cooler with modular lighting is illustrated in FIG. 20G. A proximity switch 56 is a switch that is activated by either an infrared beam or magnetic field, to power the LEDs on or off.

Figure 20H:
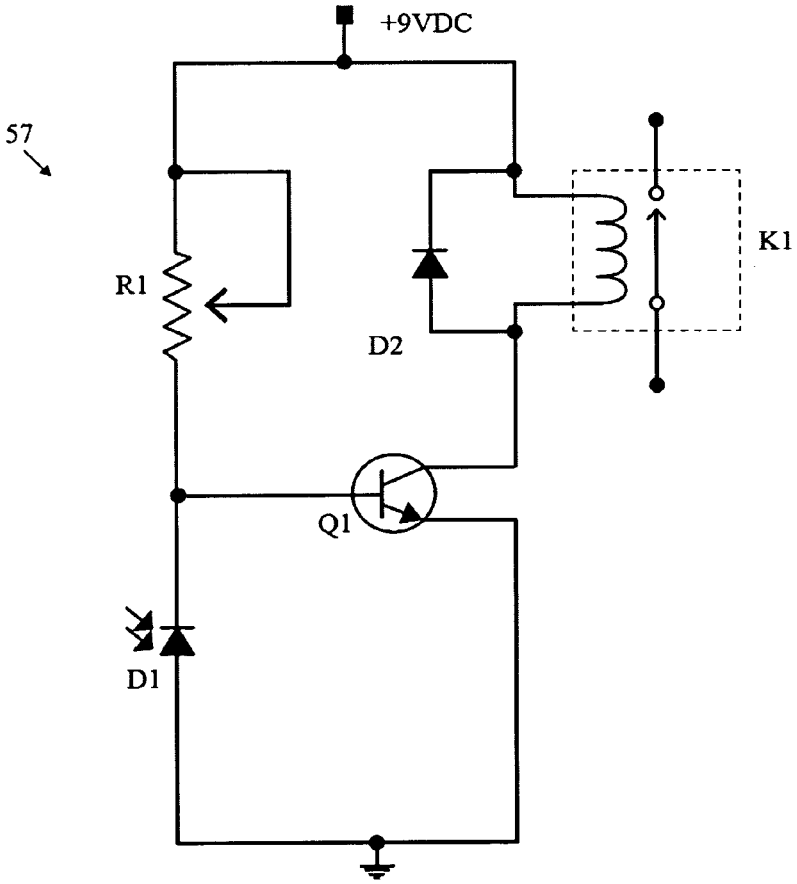
FIG. 20H is an illustration of a photo diode switch utilized with a cooler with modular lighting.

A photo diode switch 57 utilized with a cooler with modular lighting is illustrated in FIG. 20H. The photo diode switch 56 acts as a switch to break (off) or complete (on) a circuit depending on the amount of ambient light present. When the cooler 20 is being used in the day time the need for the interior of the cooler 20 to be illuminated is negated because of ambient light. The photo diode will have a high resistance in the presence of ambient light and break (off) the circuit. When the ambient light is low to none (adjusted with potentiometer) the resistance value drops through the photo diode, completing the circuit (on).

The LEDs 32 operate at very low temperatures preventing the plastic material of the cooler 20 from melting. Further, the use of LEDs 32 does not affect the inside temperature of the cooler 20. Retaining the inside temperature of the cooler 20 is one of the main priorities of the cooler 20 of the present invention. In turn, this design characteristic does not take away the basic functionality of the cooler.

The use of LEDs 32 to illuminate the inside contents of the cooler 20 in low light situations provides the consumer with the capability to visually see inside the cooler 20 when other light sources are inconvenient or unavailable.

Preferably for an eight LED 32 configuration, only one battery 41 and magnetic reed switch 42 are necessary for the cooler 20. For a sixteen LED 32 configuration, two batteries 41 and two magnetic reed switches 42 are necessary for the cooler 20. Twenty-six gauge stranded wire is also preferably utilized for the electronics of the cooler 20. Two to sixteen resistors 44 are preferably utilized for the cooler 20.

In one embodiment, the placement of the LEDs 32 in the cooler 20 are illustrated in FIG. 18. In this embodiment, each LED 32 of the pairs of LEDs 32 is positioned 1.25 inches from its pair LED 32. A distance D1 is preferably 11.5 inches. A distance D2 is preferably 4.125 inches. A distance D3 is preferably 6.25 inches. A distance D4 is preferably 1.25 inches. A distance D5 is preferably 7.75 inches. Those skilled in the pertinent art will recognize that other coolers having different dimensions can have different dimensions for the above-mentioned distances without departing from the scope and spirit of the present invention.

Figure 21:
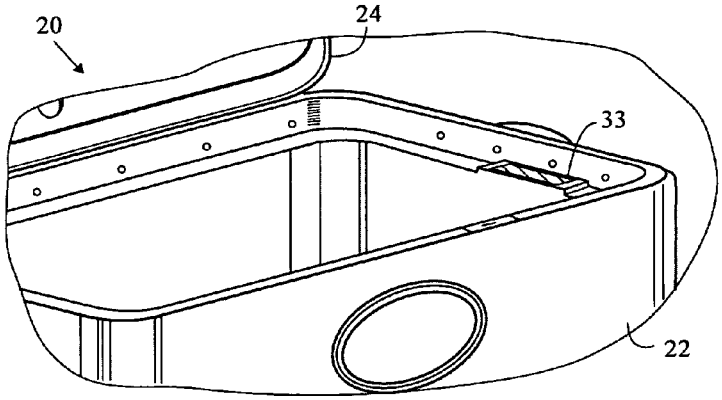
FIG. 21 is an isolated illustration of a battery of a cooler with modular lighting with a lid open to automatically activate the modular lighting.

FIG. 21 illustrates an isolated view of a cooler 20 with a modular light bar 70 and a battery 33 positioned in proximity to the modular light bar 70. The battery 33 provides power to the modular light bar 70 to enable the LEDs 32 to illuminate the cooler 20. The battery 33 may be a AA battery, a AAA battery, a C battery, a D battery, a nine-volt battery, a lithium battery, or the like.

Figure 22:
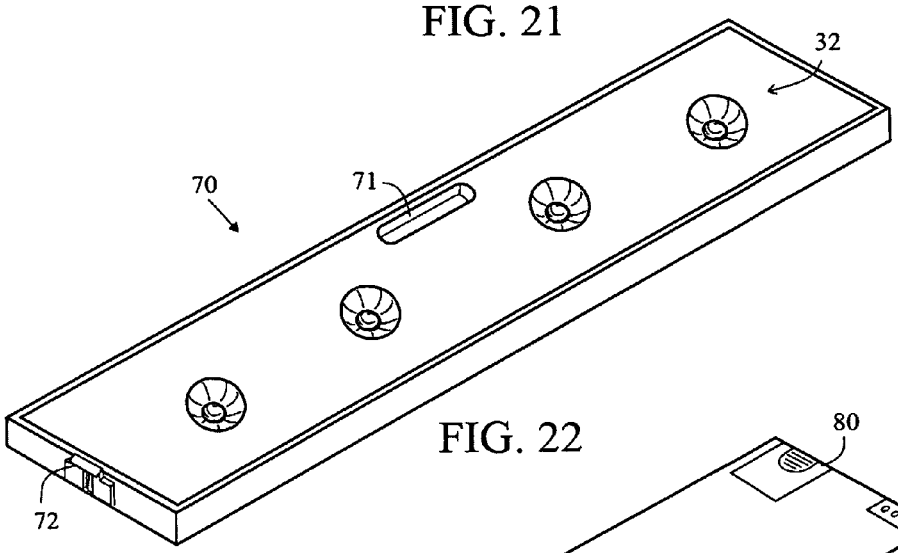
FIG. 22 is an isolated front perspective view of a modular light bar for a cooler with modular lighting.
Figure 23:
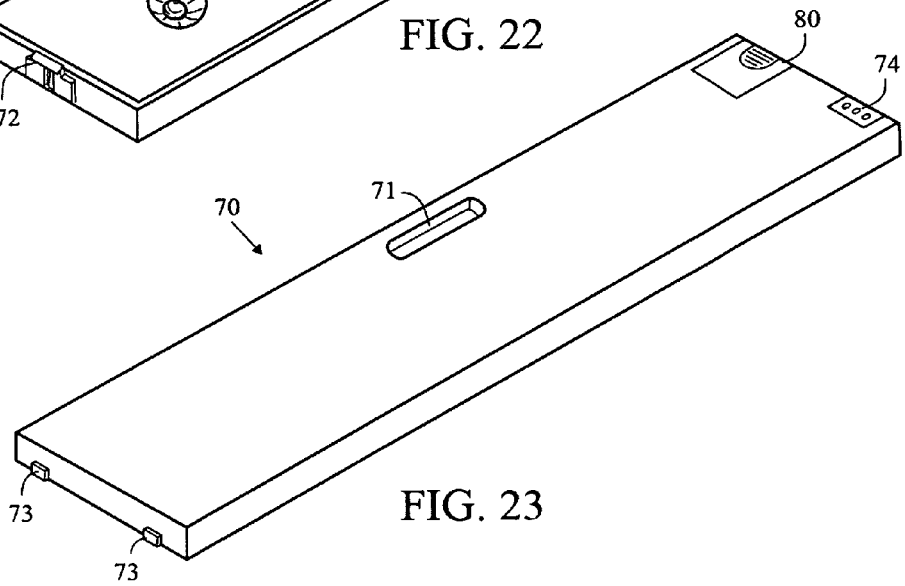
FIG. 23 is an isolated front perspective view of a modular light bar for a cooler with modular lighting.

FIGS. 22 and 23 illustrate an embodiment of a modular light bar 70 utilized with the cooler 20. The modular light bar 70 preferably comprises a handle 71 in order to remove and install the modular light bar 70 within a docking bay 76 of a wall 26 of the cooler 20. The modular light bar 70 also preferably comprises a plurality of LEDs 32 positioned within a front surface of the modular light bar 70. The modular light bar 70 also preferably comprises a release latch 72 and positioning blocks 73 for installation and removal within a docking bay 76 of a wall 26 of the cooler 20. The modular light bar 70 also preferably comprises electrical contacts 74 for electrical connection to a circuit of the cooler 20 for automatic activation (closing the circuit) and deactivation (opening the circuit) of the LEDs 32 when the lid opens and closes. The modular light bar 70 also alternatively comprises a battery compartment 80 for a placement of a battery within for powering the LEDs 32.

Figure 24:
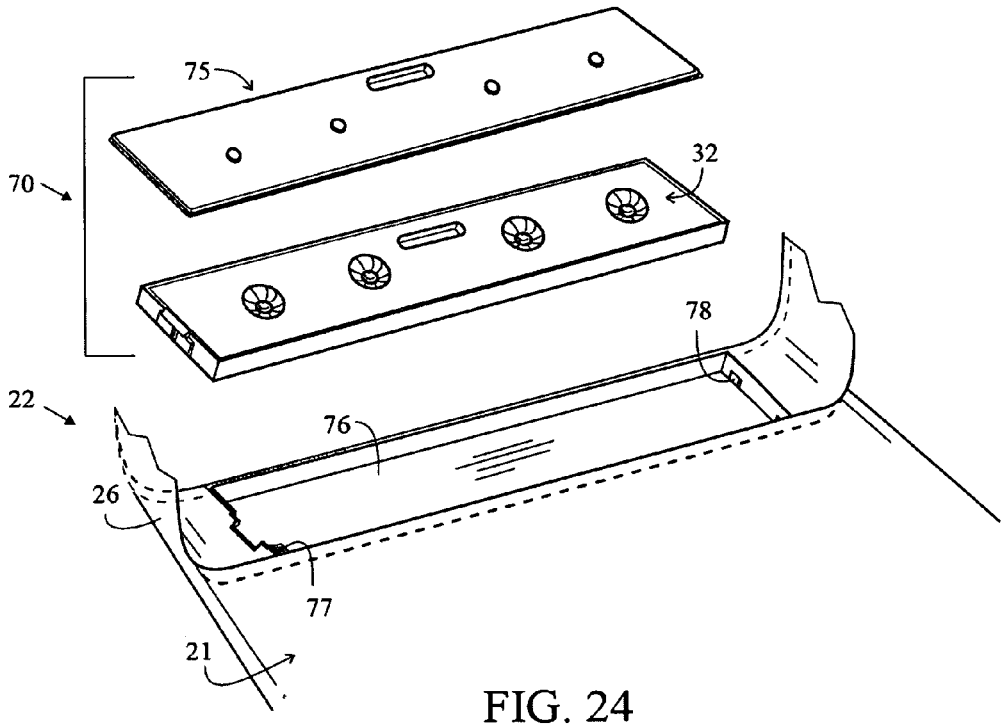
FIG. 24 is an isolated exploded view of a preferred embodiment of a modular light bar for a cooler with modular lighting.

FIG. 24 illustrates an isolated exploded view of an embodiment of a modular light bar 70 for a cooler 20 with modular lighting. The modular light bar 70 having a light cover 75 is placed within a light docking bay 76 recessed into a wall 26 of the cooler 20. The light docking bay 76 has slots 78 for engagement with the blocks 73 of the modular light bar 70. Electrical contacts 77 for the light docking bay 76 engage with the electrical contacts 74 of the modular light bar 70 in order to form part of a circuit for the cooler 20 thereby allowing for automatic activation (closing the circuit) and deactivation (opening the circuit) of the LEDs 32 when the lid opens and closes, which when activated illuminate an interior chamber 21 of the main body 22 of the cooler 20. The light docking bay 76 is preferably positioned at a top section of a wall 26 of the main body 22 of the cooler 20. Further, the cooler 20 may comprise multiple modular lights bars 70 positioned along a top section of the walls 26 of the main body 22 of the cooler 20. The modular light bar 70 may vary in length based on the size of the cooler 20, and preferably ranges from one foot to three feet, has a width preferably ranging from one inch to one foot, and preferably has a depth ranging from 0.5 inch to three inches.

Figure 25:
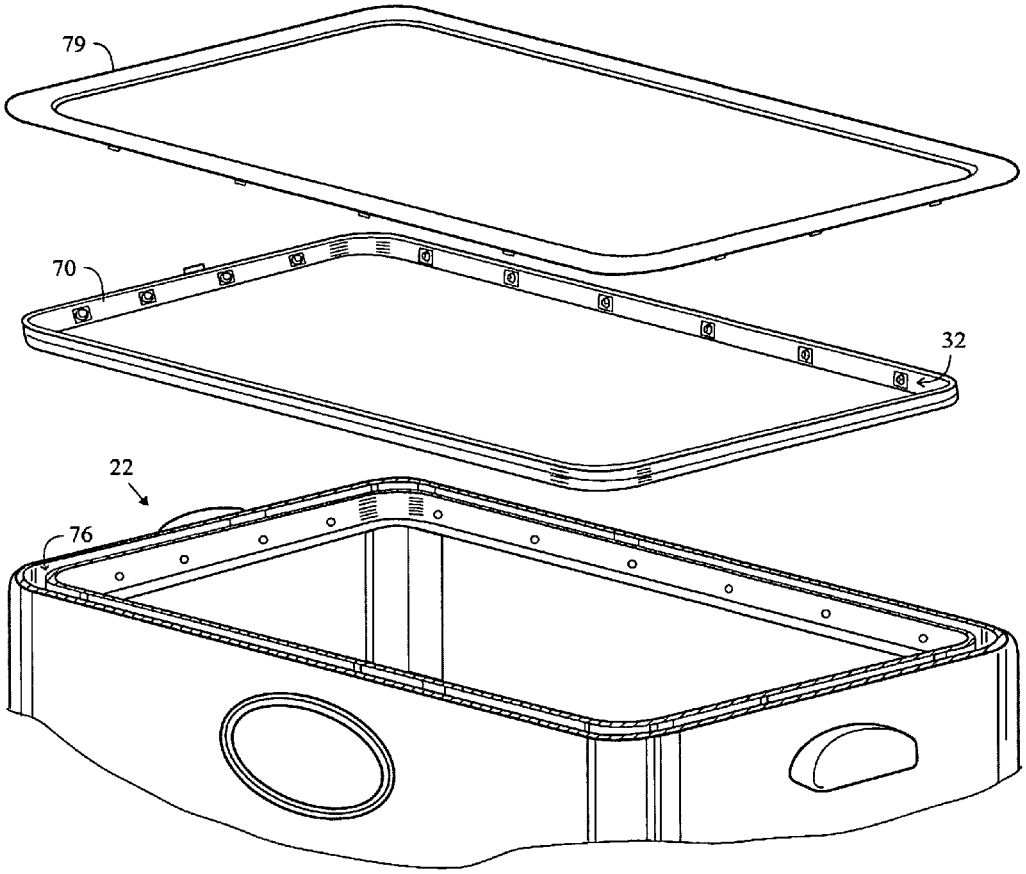
FIG. 25 is an isolated exploded view of an alternative embodiment of a modular light bar for a cooler with modular lighting.
Figure 26:
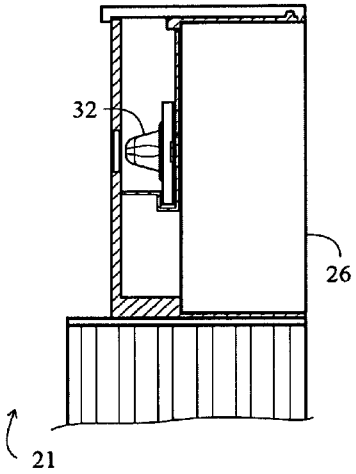
FIG. 26 is an isolated cross-sectional side view of a LED of a modular light bar for a cooler with modular lighting.
Figure 26A:
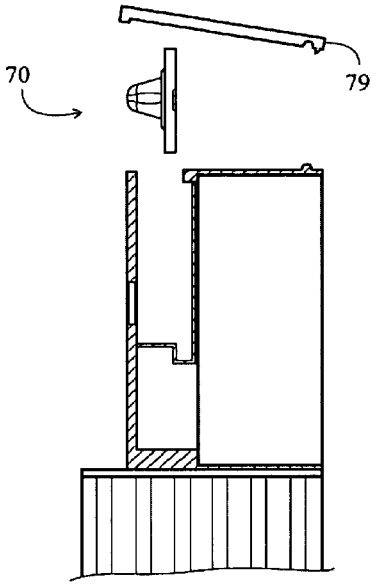
FIG. 26A is an exploded isolated cross-sectional side view of a LED of a modular light bar for a cooler with modular lighting.

FIG. 25 illustrates another embodiment of a modular light bar 70 for use with a cooler 20. The modular light 70 is continuous and completely extends around a perimeter of a main body 22 of a cooler 20. In this embodiment, the modular light bar 70 with a plurality of LEDs 32, is placed within a light docking bay 76 of the main body 22 of the cooler 20 and a snap-on top cover 79 is placed over the modular light bar 70 within the light docking bay 76 in order to secure the modular light bar 70 within the light docking bay 76. The snap-on top cover 79 is preferably transparent. FIGS. 26 and 26A illustrate the placement of the modular light bar 70 within the light docking bay 76 and the placement of the snap-on cover 79 over the light docking bay 76.

Figure 27:
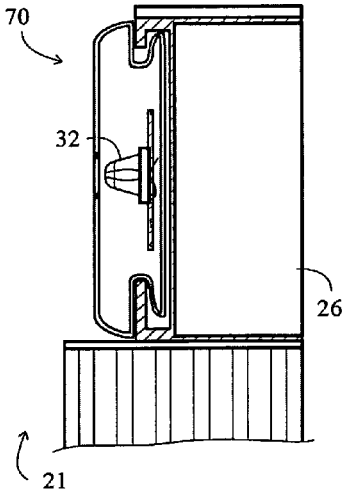
FIG. 27 is an isolated cross-sectional side view a modular light bar for a cooler with modular lighting positioned within a slot of a wall of the cooler.
Figure 27A:
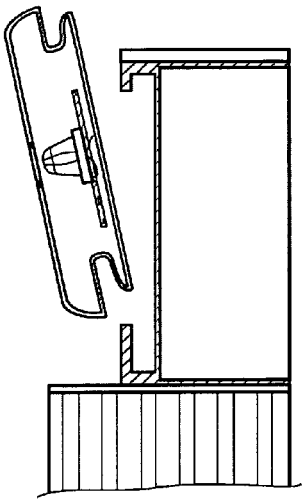
FIG. 27A is an exploded isolated cross-sectional side view a modular light bar for a cooler with modular lighting prior to positioning within a slot of a wall of the cooler.
Figure 27B:
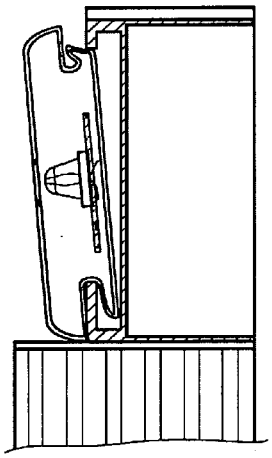

FIGS. 27, 27A and 27B illustrate another embodiment of a modular light bar 70 that snaps into a light docking bay 76 of a wall 26 of a main body 22 of a cooler 20 in order to illuminate an interior chamber 21 of the main body 22 of the cooler 20 with light from a plurality of LEDs 32 of the modular light bar 70.

In another embodiment of the invention, the modular light bar 70 is not automatically activated with the opening of a lid 24 of the cooler 20, and the modular light bar 70 has a switch to activate the LEDs 32 of the modular light bar 70.

FIGS. 30, 30A, 31 and 31A illustrate a cooler 20 with a secondary lid 24*a*. The main purpose of the secondary lid 24*a* is to reduce the amount of cool air that escapes from the interior chamber 21 when accessing the interior chamber 21. Instead of opening the primary lid 24 to access the interior chamber 21 for a beverage or food product, a user only needs to open the secondary lid 24*a* to gain access to the beverage or food product, thereby reducing the amount of cool air that escapes from the interior chamber 21, since a smaller opening is available for cool air to escape, which maintains the cold of the cooler 20 for a longer period of time. The surface area of the secondary lid 24*a* is preferably 10% to 80% of the surface area of the primary lid 24, more preferably 20% to 60% of the surface area of the primary lid 24, and most preferably 30% to 50% of the surface area of the primary lid 24.

The secondary lid 24*a* is preferably placed in the center of the primary lid 24. Alternatively, the secondary lid 24*a* is placed in proximity to an edge of the primary lid 24. Alternatively, the secondary lid 24*a* is placed to open perpendicular to an opening of the primary lid 24. Those skilled in the pertinent art will recognize that the secondary lid 24*a* may be placed in any location on the cooler 20 without departing from the scope and spirit of the present invention.

The secondary lid 24*a* has a switch 42*a* and operates in a similar manner as the primary lid 24. When the secondary lid 24*a* is in the open position, the interior 21 is illuminated. For example, in response to the lack of a magnetic field, the Hall Effect sensor closes a circuit and activates the LEDs 32 of the cooler 20 thereby allowing power to flow from the battery 41 to each of the plurality of LEDs 32 for automatically illuminating the interior of the chamber 21 of the cooler 20 when the secondary lid 24*a* is open and the magnetic field is removed.

Figure 32:
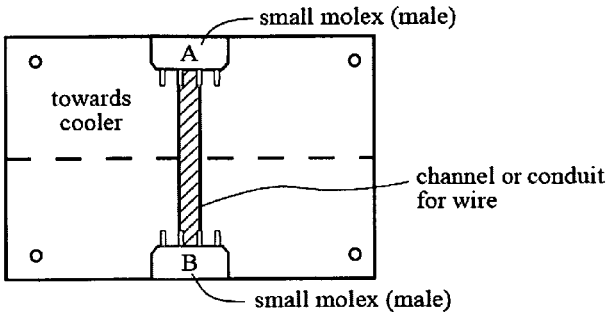
FIG. 32 is a view of a cooler with a secondary lid illustrating the internal components.
Figure 33:
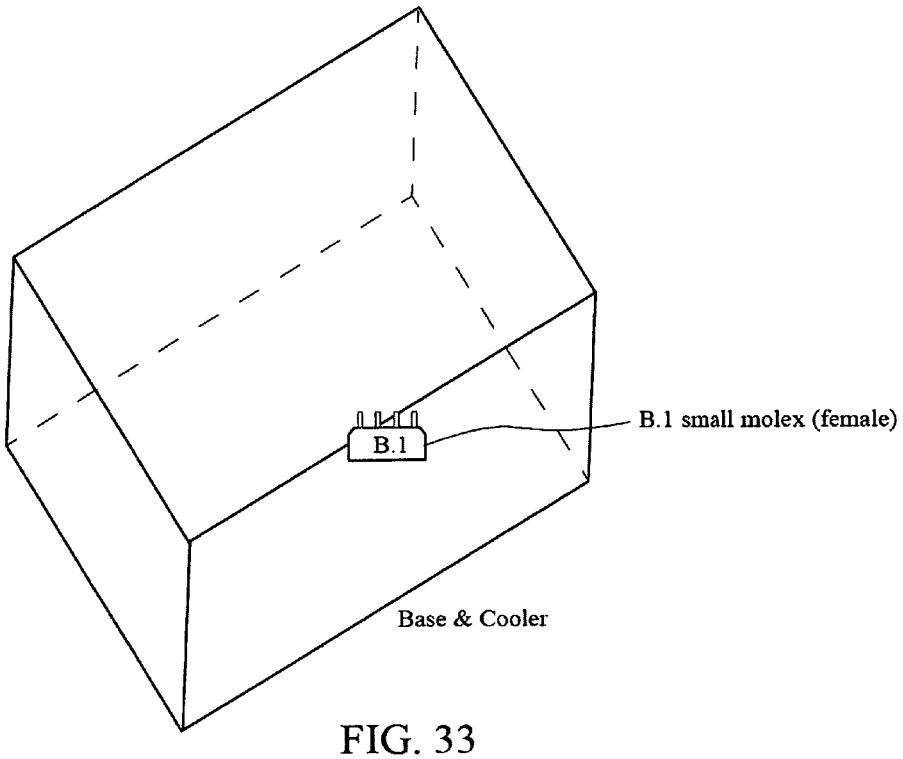
FIG. 33 is a view of a cooler with a secondary lid illustrating the internal components.

FIGS. 32-33 illustrate a small molex connector A, male, built in the hinge and connected to small molex connector A1. A small molex connector A1, female, is built into the lid and connecting to the secondary lid reed switch. A small molex connector B, male, built into the hinge and connected to small molex connector A through wires in a small conduit to connector to small molex connector B1. A small molex connector B1 is female, built into the base of the cooler, connecting small molex connector B to the ground side, along with the first reed switch, inside the base of the cooler. A secondary reed switch C is in the secondary lid. A channel D is built into the hinge for wire protection.

The light modular bar 70 may also be utilized with the invention of Sandberg, U.S. Pat. No. 7,722,204 for a Cooler, which is hereby incorporated by reference in its entirety. The light modular bar 70 may also be utilized with the invention of Sandberg, U.S. Pat. No. 8,210,702 for a Cooler With LED Lighting, which is hereby incorporated by reference in its entirety. The light modular bar 70 may also be utilized with the invention of Sandberg, U.S. patent application Ser. No. 13/794,830, filed on Mar. 12, 2013, for a Cooler With LED Lighting, which is hereby incorporated by reference in its entirety. The light modular bar 70 may also be utilized with the invention of Sandberg, U.S. patent application Ser. No. 13/794,838, filed on Mar. 12, 2013, for a Cooler With LED Lighting, which is hereby incorporated by reference in its entirety.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes modification and substitutions of equivalents may be made therein without departing from the spirit and scope of this invention which is intended to be unlimited by the foregoing except as may appear in the following appended claim. Therefore, the embodiments of the invention in which an exclusive property or privilege is claimed are defined in the following appended claims.

I claim as my invention:

1. A cooler having an interior of a chamber, the cooler comprising:

a body having a plurality of walls that define the interior of the chamber;

a primary lid attached to the body, the primary lid movable from a closed state to an open state;

at least one modular light bar having a plurality of LEDs;

a battery;

at least one resistor positioned between the battery and the at least one modular light bar; and a first switch positioned between the battery and the at least one modular light bar;

a secondary lid positioned within the primary lid and having a surface area smaller than the surface area of the primary lid;

a second switch;

wherein the first switch is in a closed state when the primary lid of the cooler is open thereby allowing power to flow from the battery to the at least one modular light bar for illuminating the interior chamber of the cooler;

wherein the second switch in a closed state when the secondary lid of the cooler is open thereby allowing power to flow from the battery to the at least one modular light bar for illuminating the interior chamber of the cooler.

2. The cooler according to claim 1 wherein the first switch is a plunger switch.

3. The cooler according to claim 1 wherein the first switch is an on/off rocker switch.

4. The cooler according to claim 1 wherein the first switch is a lever switch.

5. The cooler according to claim 1 wherein the first switch is a ball switch.

6. The cooler according to claim 1 wherein the first switch is a Hall Effect sensor switch.

7. The cooler according to claim 1 wherein the first switch is a mercury switch.

8. The cooler according to claim 1 wherein the first switch is a photo diode switch.

9. The cooler according to claim 1 wherein the first switch is a light dependent resistor switch.

10. The cooler according to claim 1 wherein the first switch is a proximity switch.

11. A cooler having an interior of a chamber, the cooler comprising:

a main body having a plurality of walls that define the interior of the chamber;

a primary lid attached to the main body, the primary lid movable from a closed state to an open state;

a plurality of LEDs;

a battery for providing power to the plurality of LEDs; and a first switch positioned between the battery and the plurality of LEDs;

a secondary lid positioned within the primary lid and having a surface area smaller than the surface area of the lid;

a second switch;

wherein the first switch is in a closed state when the primary lid of the cooler is open thereby allowing power to flow from the battery to the plurality of LEDs for automatically illuminating the interior of the chamber of the cooler;

wherein the second switch in a closed state when the secondary lid of the cooler is open thereby allowing power to flow from the battery to the plurality of LEDs for illuminating the interior of the chamber of the cooler.

12. The cooler according to claim 11 wherein the first switch is selected from the group consisting of a plunger switch, an on/off rocker switch, a lever switch, a ball switch, a Hall Effect sensor switch, a mercury switch, a light dependent resistor switch, and a proximity switch.

13. A cooler having an interior of a chamber, the cooler comprising:

a main body having a plurality of walls that define the interior of the chamber;

a primary lid attached to the main body, the primary lid movable from a closed state to an open state;

at least one modular light bar;

a battery for providing power to the at least one modular light bar; and a first switch positioned between the battery and the at least one modular light bar for activating the at least one light modular bar;

a secondary lid positioned within a center of the primary lid and having a surface area smaller than the surface area of the primary lid;

a second switch, wherein the second switch in a closed state when the secondary lid of the cooler is open thereby allowing power to flow from the battery to the at least one light modular bar for illuminating the interior of the chamber of the cooler.

14. The cooler according to claim 13 wherein a wall of the plurality of walls comprises a light docking bay for placement of the at least one light modular bar therein.

15. The cooler according to claim 13 further comprising a plurality of light modular bars.

16. The cooler according to claim 13 wherein the at least one light modular bar is continuous and extends around a perimeter of the main body of the cooler.

17. The cooler according to claim 13 further comprising a transparent cover for the at least one light modular bar.

* * * * *